US005908821A

United States Patent [19]

Labeque et al.

[11] Patent Number: 5,908,821

[45] **Date of Patent: *Jun. 1, 1999**

[54] DYE TRANSFER INHIBITING COMPOSITIONS WITH SPECIFICALLY SELECTED METALLO CATALYSTS

[75] Inventors: Regine Labeque, Brussels; James Pyott Johnston, Overijse, both of Belgium

[73] Assignee: Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/737,542

[22] PCT Filed: Apr. 25, 1995

[86] PCT No.: PCT/US95/05035

§ 371 Date: Nov. 11, 1996

§ 102(e) Date: Nov. 11, 1996

[87] PCT Pub. No.: WO95/31526

PCT Pub. Date: Nov. 23, 1995

[30] Foreign Application Priority Data

May 11, 1994 [EP] European Pat. Off. ..... 94870078

[51] Int. Cl.[6] ..... C11D 3/395; C11D 7/54

[52] U.S. Cl. ..... 510/311; 510/305; 510/312; 510/313; 510/315; 510/357; 510/374; 510/376; 510/377; 510/500; 510/513

[58] Field of Search ..... 510/302, 305, 510/311, 314, 374, 500, 508, 513, 312, 315, 353, 376, 377, 313, 357

[56] References Cited

U.S. PATENT DOCUMENTS

| | | | |
|---|---|---|---|
| 4,077,768 | 3/1978 | Johnston et al. | 8/107 |
| 4,240,920 | 12/1980 | DeLuque | 8/101 |
| 4,648,992 | 3/1987 | Graf et al. | 8/111 |
| 4,672,047 | 6/1987 | Chandler | 502/62 |
| 4,892,941 | 1/1990 | Dolphin et al. | 540/145 |
| 4,990,280 | 2/1991 | Thorengaard et al. | 8/103 |
| 5,288,746 | 2/1994 | Pramod | 510/303 |
| 5,345,008 | 9/1994 | Lyons et al. | 568/909.8 |
| 5,486,274 | 1/1996 | Thetford et al. | 204/157.5 |
| 5,608,053 | 3/1997 | Thetford et al. | 540/140 |

FOREIGN PATENT DOCUMENTS

| | | | |
|---|---|---|---|
| 0 306 089 | 3/1989 | European Pat. Off. | C11D 3/395 |
| 384503 | 8/1990 | European Pat. Off. . | |
| 0 538 228 | 4/1993 | European Pat. Off. | C11D 3/00 |
| 537381 | 4/1993 | European Pat. Off. . | |
| 0 596 184 | 5/1994 | European Pat. Off. | C11D 3/00 |
| 0 622 447 | 11/1994 | European Pat. Off. | C11D 3/00 |
| 0 622 448 | 11/1994 | European Pat. Off. | C11D 3/20 |
| WO 94/24250 | 10/1994 | WIPO | C11D 3/00 |

*Primary Examiner*—Paul Lieberman
*Assistant Examiner*—Caroline L. Dusheck
*Attorney, Agent, or Firm*—Brian M. Bolam; Kim W. Zerby; Richard S. Echler, Sr.

[57] ABSTRACT

The present invention relates to compositions for inhibiting dye transfer between fabrics during washing. The compositions are specifically selected metallo catalysts; namely, porphyrins and phthalocyanines. Detergent compositions containing such porphyrins and/or phthalocyanines are also disclosed.

20 Claims, No Drawings

DYE TRANSFER INHIBITING COMPOSITIONS WITH SPECIFICALLY SELECTED METALLO CATALYSTS

FIELD OF THE INVENTION

The present invention relates to a composition and a process for inhibiting dye transfer between fabrics during washing. More in particular, the present invention relates to a composition and a process for inhibiting dye transfer between fabrics during washing comprising specifically selected metallo catalysts.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to bleach the fugitive dyes washed out of dyed fabrics before they have the opportunity to become attached to other articles in the wash.

Suspended or solubilized dyes can to some degree be oxidized in solution by employing known bleaching agents.

However it is important at the same time not to bleach the dyes actually remaining on the fabrics, that is, not to cause color damage.

U.S. Pat. No. 4,077,768 describes a process for inhibiting dye transfer by the use of an oxidizing bleaching agent together with a catalytic compound such as iron porphins.

Copending EP Patent Application 91202655.6 filed Oct. 9, 1991, relates to dye transfer inhibiting compositions comprising an enzymatic system capable of generating hydrogen peroxide and porphin catalysts.

It has now been found that specifically selected metallo catalysts in the presence of an efficient amount of a quick releasing bleaching agent are very efficient in preventing dye transfer.

Accordingly, a dye transfer inhibiting composition is provided which exhibits optimum dye transfer inhibiting properties.

According to another embodiment, the invention provides an efficient process for laundering operations involving colored fabrics.

SUMMARY OF THE INVENTION

The present invention relates to inhibiting dye transfer compositions comprising i) one or more of a specific metallo catalyst selected from the group of porphyrins and/or phthalocyanines, ii) an efficient amount of bleaching agent.

DETAILED DESCRIPTION OF THE INVENTION

The term "specific metallo catalysts" herein encompasses one or more of a specific metallo catalyst selected from the groups of porphyrins and/or phthalocyanines as defined below.

A) porphyrins having the following formula I:

FORMULA I

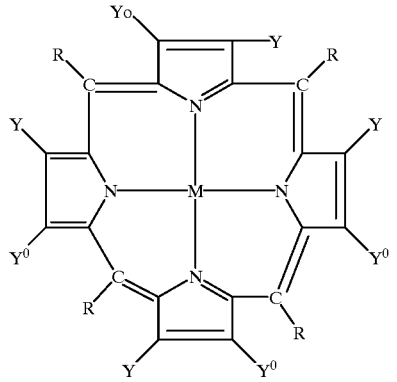

wherein M is a transition metal capable of sustaining oxidation, and if desired may also be joined to one or more axial ligands in addition to the four nitrogen groups, each Y and Y° is independently H, fluoro or chloro, each R ring is

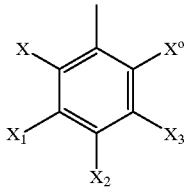

X and X' are independently H or an electronegative group which is not a water solubilizing group, eg. X and X' are independently, fluoro, chloro, bromo, or $NO_2$, $X_1$, $X_2$ and $X_3$ are independently H or an electronegative group, including water solubilizing electronegative groups, including without limitation fluoro, chloro, bromo, $SO_3H$, COOH or $NO_2$, subject to the provisions that 1) when none of X1, X2 and X3 is a water solubilizing group, then at least one Y and Y° on each porphyrin ring is other than H, 2) when Y and Y° are both H, at least one but not more than two of $X_1$, $X_2$ and $X_3$ is a water solubilizing group, eg. $SO_3H$ or COOH, and at least two of X and X° and the $X_1$, $X_2$ and $X_3$ which are not a water solubilizing group are independently an electronegative group which is not a water solubilizing group, e.g. fluoro, chloro, bromo or $NO_2$, and 3) no more than two of $X_1$, $X_2$ and $X_3$ are water solubilizing groups, or the water soluble salts thereof; and compounds of formula I in which said water solubilizing groups are in corresponding water soluble salt form.

Particular subgroups of the compounds of the formula I are the compounds of the formulae Ia and Ib.

The compounds of the formula Ia are those with reference to the structural formula I in which :

a) at least one of Y and Y° on each porphyrin ring is fluoro or chloro and the other is H, fluoro or chloro, b) X and X° are independently H, fluoro, chloro, bromo or $NO_2$, c) $X_1$, $X_2$ and $X_3$ are independently H, fluoro, chloro, bromo, $SO_3H$, COOH or $NO_2$, provided that no more than two of $X_1$, $X_2$ and $X_3$ are $SO_3H$ or COOH, and d) M is as above defined.

The compounds of the formula Ib are those with reference to the structural formula I in which a) Y and Y° are independently H, fluoro or chloro, b) X and X' are independently H, fluoro, chloro, bromo or $NO_2$, c) $X_1$, $X_2$ and $X_3$ are independently H, fluoro, chloro, bromo, $SO_3H$, COOH and $NO_2$ with the provisions that i) at least one but not more than two of $X_1$, $X_2$ and $X_3$ are $SO_3H$ or COOH, and ii) at least two of X, X°, $X_1$, $X_2$ and $X_3$ is fluoro, chloro, bromo or $NO_2$, and d) M is as above defined.

The preferred compounds of the formula Ia have one or more of the following features a) both Y and Y° on each porphyrin ring is fluoro or chloro;

b) at least two of X, X°, $X_1$, $X_2$ and $X_3$ are fluoro or chloro, more particularly with X and X° being fluoro or chloro, and c) M is Fe, Cr, Mn, Co, Ru, Rh, Mo, V.

More preferred compounds of the formula Ia have one or more of the following features a) both Y and Y° on each porphyrin ring is chloro;

b) at least two of X, X°, $X_1$, $X_2$ and $X_3$ are chloro, more particularly with X and X° being chloro, and c) M is Fe, Mn.

The preferred compounds of the formula Ib have one or more of the following features a) Y and Y° on each porphyrin ring is independently H or chloro;

b) one of $X_1$, $X_2$ and $X_3$ is $SO_3H$, c) at least two of X, X°, $X_1$, $X_2$ and $X_3$ are fluoro or chloro, and d) M is Fe, Cr, Mn, Co, Ru, Rh, Mo, V.

More preferred compounds of the formula Ib have one or more of the following features :

a) Y and Y° on each porphyrin ring are independently H or chloro, b) one of $X_1$, $X_2$ and $X_3$ is $SO_3H$, c) at least two of X, X°, $X_1$, $X_2$ and $X_3$ are chloro, more particularly with X and X° being chloro, and d) M is Mn, Fe.

Another preferred subclass of the compounds of the formula Ib are those in which one of Y and Y° on each porphyrin is other than H, more particularly those in which both Y and Y° are fluoro or chloro.

With regard to each R ring as described above, each R ring will contain the minimum substitution provided for above, but the positioning and number of substitutions above the minimum on each R ring may vary. Preferably, each R ring is the same.

In general, it is preferred that only one of $X_1$, $X_2$ and $X_3$ is a water solubilizing group. It is also more particularly preferred that when one of Y or Y° is to be other than H, that both be other than H.

A subclass of the compounds of the formula Ib described in application Ser. No. 039,566 of Apr. 17, 1987, in which Y and Y° are H, X and X° are each chloro, $X_1$ and $X_2$ are H and $R_3$ is an electronegative group including a water solubilizing group is in free acid form and those with and without ligands such as the chloride ligand form.

The compounds of the invention having $SO_3H$ or COOH groups are water soluble and the invention also includes such water soluble compounds in which such groups are in water soluble salt form with a cation of a base such as an alkali metal (sodium, potassium or lithium), and alkaline earth metal, or an ammonium cation, preferably an alkali metal or ammonium cation. Such salt forms may be prepared by reacting a compound of the formula I with a base by conventional procedures.

M may be any transition metal which is capable of sustaining oxidation. Examples of preferred metals include Fe, Cr, Mn, V, Rh, Ru and Co. Particularly preferred metals are Fe and Mn. Additionally the metal may be joined to a ligand, The axial ligands, usually one or two but occasionally more, may be virtually any group which is capable of forming a single hydrolysable bond with the M, as known in the art. Examples of axial ligands by way of illustration only include —$OCH_3$, —OH, amines, halide ions, particularly chloride, and water.

B) Substituted phthalocyanines in which at least one of the peripheral carbon atoms in the 1–16 positions of the phthalocyanine nucleus (M Pc), as shown in Formula (1)

Formula (1)

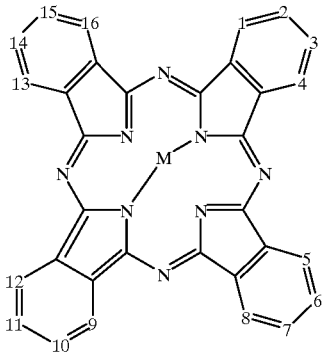

wherein M is selected from Fe, Cr, Mn, Co, Ru, Rh, Mo, V are unsubstituted or substituted by any combination of atoms or groups and sulphonated derivatives thereof provide that the phthalocyanine absorbs electromagnetic radiation at a wavelength from 650 nm to 800 nm.

In the present phthalocyanines the phthalocyanine nucleus is complexed with a metal represented by M. Preferred metals represented by M are Fe, Mn, Co, Rh, Cr, Ru, Mo or V.

In the phthalocyanines used in the present invention each of the pendant organic radicals linked via oxygen to the phthalocyanine nucleus is independently selected from aromatic, heteroaromatic, aliphatic and alicyclic radicals, such that any one phthalocyanine nucleus may carry two or more different organic radicals.

It is preferred that each pendant organic radical is independently selected from mono- and bi-cyclic aromatic and heteroaromatic radicals.

Examples of suitable mono- and bi-cyclic aromatic and heteroaromatic radicals are phenyl, naphthyl, especially naphth-2-yl, pyridyl, thiophenyl, furanyl, quinolinyl, thiazolyl, benzothiazolyl and pyrimidyl each of which may be substituted.

Where the pendant organic radical is an aliphatic or alicyclic radical it is preferred that it is selected from $C_{1-20}$-alkyl especially $C_{1-10}$ alkyl; $C_{2-20}$ alkenyl especially $C_{3-10}$ alkenyl and $C_{4-8}$ cycloalkyl especially cyclohexyl, each of which may be substituted.

Optional substituents for the pendant organic radicals are preferably selected from $C_{1-20}$ alkyl, especially $C_{1-4}$ alkyl; $C_{1-20}$ alkoxy, especially $C_{1-4}$ alkoxy, $C_{1-20}$ alkenyl, especially C2–4 alkenyl; $C_{1-20}$ alkylthio, especially $C_{1-4}$ alkylthio; $C_{1-20}$ alkoxycarbonyl, especially $C_{1-4}$ alkoxycarbonyl; hydroxy$C_{1-4}$ alkoxy, aryl, especially phenyl; $C_{1-4}$ alkylaryl, especially benzyl; arylthio, especially phenylthio; halogen, especially fluoro, chloro and bromo; —CN;—$NO_2$;—$CF_3$;—$COR^2$;—$COOR^2$;—$CONR^2R^3$, —$SO_2R^2$, —$SO_2NR^2R^3$ and —OR2 in which $R^2$ and $R^3$ are independently selected from —H; alkyl, especially $C_{1-4}$ alkyl; aryl, especially phenyl; $C_{1-4}$ alkylaryl, especially benzyl and —$SO_3A$ in which A is H, or a metal or ammonium ion or substituted ammonium ion.

In the phthalocyanines used in the present invention it is preferred that from 4 to 16 of the peripheral carbon atoms are linked via an oxygen atom to a pendant organic radical and it is especially preferred that all 16 peripheral carbon atoms are linked via an oxygen atom to a pendant organic radical.

Examples of suitable atoms or groups which can be attached to any of the remaining peripheral carbon atoms of the phthalocyanine nucleus are hydrogen, halogen, sulphonate groups —$SO_3A$ in which A is H, or a metal or ammonium ion or a substituted ammonium ion, and any of the pendant organic radicals described above and hereinafter represented by R. It is preferred that the atoms or groups attached to the remaining peripheral carbon atoms are selected from —H, —F, —CI, —Br, —I, —$SO_3H$, —$SO_3Na$, —$SO_3K$, —$SO_3Li$ and —$SO_3NH_4$ or any combination thereof. It is especially preferred that these atoms or goups are —H, —CI, —Br, —$SO_3H$, —$SO_3Na$ or —$SO_3NH_4$.

The sulphonated derivatives of the phthalocyanines used in the present invention carrying up to 50 $SO_3A$ groups, preferably up to 40 $SO_3A$ groups and more preferably up to 30 $SO_3A$ groups, which are attached directly to the phthalocyanine nucleus and/or to the pendant organic radicals are a preferred group of compounds for the present invention.

In the preferred group the average number of $SO_3A$ groups is preferably from 2 to 40 and more preferably from 2 to 30 and especially, preferably 16 to 30. It is also preferred that for each pendant organic radical there is at least one $SO_3A$ group, although each organic radical may carry none, one or more than one $SO_3A$ group.

Where A is a metal ion it is preferably an alkali or alkaline earth metal ion, especially an alkali metal ion such as a sodium, potassium or lithium ion. Where A is an ammonium ion it is preferably $^+NH_4$ or a substituted ammonium ion which enhances the water-solubility of the compound. Examples of suitable substituted ammonium ions which enhance the water solubility of the compound are mono, di, tri and tetra alkyl and hydroxylalkyl ammonium ions in which the alkyl groups preferably contain from 1 to 4 carbon atoms such as $^+N(CH_3)_4$; $^+N(C_2H_5)_4$; $^+N(C_2H_4OH)_4$; $^+NH_3CH_3$; $^+NH_2(CH_3)_2$ and $^+NH(CH_3)_3$.

The substituted ammonium ion represented by A preferably has one fatty alkyl group as described above, the remaining groups being preferably H or $C_{1-4}$ alkyl, especially H or methyl. Suitable ammonium ions include 2-ethylhexylammonium,1,1,3,3-tetramethylbutylammonium and 3,5,5-trimethylhexylammonium.

In compounds of the Formula (1) each of the peripheral carbon atoms in the 1 to 16 positions of the phthalocyanine nucleus are attached to a group Y and each Y is independently selected from —H, halogen, —$SO_3A$ in which A is as hereinbefore defined, and OR in which R is a pendant organic radical as hereinbefore defined.

According to a further feature of the present invention there are provided phthalocyanine compounds of the Formula (2)

$$M\ Pc\ (O—R)_aX_b(SO_3A)_d \quad (2)$$

wherein:

M Pc is a phthalocyanine nucleus as defined in Formula (1); each R independently is an organic radical; each X independently is a halogen or hydrogen; the O—R and X groups being attached to one or more or the 16 peripheral carbon atoms of the phthaloxyanine nucleus;

A is selected from H, a metal, ammonium or substituted ammonium as described above;

a is from 1 to 16;

b is from 0 to 15;

d is an average value from 0.1 to 50;

a+b is from 1 to 16;

In phthalocyanines of Formula (2) M is any of the metals described above for M.

In phthalocyanines for Formula (2) it is especially preferred that M is Fe, Mn.

In a phthalocyanine of Formula (2) each of the radicals denoted by R may be selected from any of the pendant organic radicals hereinbefore defined in relation to Formula (1) above.

In a phthalocyanine of formula (2) it is preferred that a is from 4 to 16 and more preferably from 5 to 16. It is especially preferred that a is 16.

In a phthalocyanine of Formula (2) each halogen denoted by X is preferably independently selected from —F, —CI, —Br and —I and it is especially preferred that each halogen denoted by X is independently —CI or —Br.

In a phthalocyanine of Formula (2) it is preferred that b is from 0 to 12, and more preferably from 0 to 11. When a+b is<16 the remainder of the 16 peripheral carbon atoms, not carrying a group O–R or X, may carry a sulphonate group, —$SO_3A$ or a group represented by R. It is however preferred that the sum of a+b is 16. It is also preferred that a is 4, 8, 12 or 16, and especially 8, 12 or 16.

In phthalocyanines of Formula (2) the metal ion denoted by A is preferably an alkali or alkaline earth metal ion and more preferably is selected from lithium, sodium and potassium ion. It is especially preferred that a is a sodium, an ammonium ion or hydrogen.

In phthalocyanines of Formula (2) it is preferred that d is an average value from 2 to 40. It is more preferred that d is an average value from 2 to 30, especially preferred that d is an average value from 16 to 30.

According to a further feature of the present invention there are provided phthalocyanine compounds of the Formula (3):

$$M\ Pc\ (O—R^1)_aX_b \quad (3)$$

wherein

M Pc is as defined in Formula (1)

$R^1$ is selected from optionally substituted aryl and optionally substituted heteroaryl;

X is halogen or H;

a is an integer from 1 to 16;

b is an integer from 0 to 15; and a+b is equal to 16.

Preferred phthalocyanine compounds of formulae (3) are those (1) wherein :

M is selected from Mn, Fe, Co;

X is halogen;

a is 4, 8 or 12; and b is 12, 8 or 4.

(2) wherein:

M is selected from Mn, Fe, Co, V;

X is halogen;

a is 4, 8 or 12 and b is 12, 8, 4.

(3) wherein:

M is selected from Mn, Fe;

X is hydrogen;

a is 8 or 12; and b is 8 or 4.

(4) wherein:

M is selected from Fe, Mn, Ni;

a is from 5 to 16; and b is from 11 to 0.

(5) wherein:

M is selected from Fe, Mn, Ni;

a is from 1 to 3, and b is from 15 to 3.

(6) wherein:

M is selected from Fe, Mn, Co, Ni and V;

X is halogen;

a is from 1 to 16; and b is from 15 to 0.

(7) wherein:

M is selected from Fe, Mn, Co, Ni and V;

a is from 1 to 14; and b is from 15 to 2, provided that at least one X is H and one X is halogen.

In a phthalocyanine of Formula (3) it is preferred that each of the radicals denoted by $R^1$ is independently selected from mono- or bi-cyclic aromatic or heteroaromatic radicals. Examples of suible aromatic and heteroaromatic radicals are those described above for R. The radicals denoted by $R^1$ are more preferably phenyl or naphthyl, especially 2-naphthyl. Preferred substituents for the $R^1$ group are as described for R.

In a phthalocyanine of Formula (3) it is preferred that a is an integer from 4 to 16 and that b is an integer from 12 to 0. It is also preferred that a is 4, 8, 12 or 16, more especially 8, 12 or 16, and that b is 12, 8, 4 or 0.

In a phthalocyanine of Formula (3) it is preferred that the metal denoted by M is Fe, Mn, Co, Cr, Ru, Rh, Mo, V.

The phthalocyanines can be sulphonated directly on the Pc nucleus, particularly when any of the 1–16 positions is unsubstituted (i.e. the 1–16 peripheral carbon atoms carry a hydrogen atom) or on any of the pendant organic groups R or $R^1$, or on both the Pc nucleus and the pendant organic groups.

The preferred molar range of the specifically selected metallo catalyst of the present invention in the wash is $10^{-8}$ molar to $10^{-3}$ molar, more preferably $10^6$ to $10^4$ molar.

An efficient amount of bleaching agent

The dye transfer inhibiting compositions according to the present invention comprise an efficient amount of bleaching agent.

According to the present invention, an efficient amount of bleach is by definition the necessary amount of bleach which combined with a bleach catalyst leads to a level of dye oxidation which is between 40% to 100%, preferably 40% to 60%, more preferred 60% to 80%, most preferred 80%–100% of the maximum (Z) per cent of dye oxidation that can be achieved under the most optimal conditions determined by those skilled in the art.

The bleaches suitable for the present invention can be activated or non-activated bleaches.

Preferably, the bleaches suitable for the present invention include peroxygen bleaches. Examples of suitable water-soluble solid peroxygen bleaches include hydrogen peroxide releasing agents such as hydrogen peroxide, perborates, e.g. perborate monohydrate, perborate tetrahydrate, persulfates, percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzenesulfonate (NOBS, described in U.S. Pat. No. 4,412,934),3,5,5-trimethylhexanoloxybenzenesulfonate (ISONOBS, described in EP 120,591), or pentaacetylglucose (PAG), which are perhydrolyzed to form a peracid as the active bleaching species, leading to improved bleaching effect.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

Test Methods:

For a given catalyst concentration, temperature and pH, the following two test methods can be used to estimate the optimum bleach level that gives the maximum level of dye oxidation, i.e. Z.

(a) In solution dye bleaching:

In a detergent solution, fix the initial concentration of dye (e.g. 40 ppm) and catalyst. Record the absorbance spectrum of this solution using a UV-Vis spectrophotometer according to procedures known to those skilled in the art. Add a given concentration of bleach (H202, oxone, percarbonate, perborate, activated bleach, etc.) and stir the solution containing the dye and catalyst. After stirring for 30 min, record again the absorbance spectrum of the solution. The amount of dye oxidation can then be determined from the change in the absorbance maximum for the dye. Keeping the experimental conditions the same, vary the amount of bleach so as to achieve the maximum dye oxidation.

(b) Reduction of dye transfer from fabric to another fabric

In either a washing machine or launderometer, add a known bleeding fabric and a known uncolored pick-up tracer (e.g. cotton) to the wash load. After simulating a wash cycle, determine the amount of dye that has been picked up by the tracer according to methods known to those skilled in the art. Now to separate washing machines, add the same amount of bleeding fabric and pick-up tracer, a fixed amount of catalyst and vary the bleach level. Determine the level of dye transfer onto the pick-up tracers and vary the amount of bleach as to minimize dye transfer. In this way the most optimal bleach concentration can be determined.

DETERGENT ADJUNCTS

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

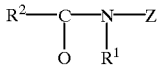

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R—CH(COOH) CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as well as the corresponding soaps.

Preferred saturated species have from 12 to 16 carbon atoms in the alkyl chain. The preferred unsaturated fatty acid is oleic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions the purposes of the invention include inorganic materials such as alkali metal carbonates, bicarbonates, silicates, and organic materials such as the organic phosphonates, amiono polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Other components used in detergent compositions may be employed, such as bleaches, suds boosting or depressing agents, enzymes and stabilizers or activators therefor, soil-suspending agents soil-release agents, optical brighteners, abrasives, bactericides, tarnish inhibitors, coloring agents, and perfumes. Especially preferred are combinations with technologies which also provide a type of color care benefit. Examples of these technologies are polyvinylpyrrolidone polymers and other polymers which have dye transfer inhibiting properties. Another example of said technologies are cellulase for color maintenance/rejuvenation.

Other examples are polymers disclosed in EP 92870017.8 filed Jan. 31, 1992 and enzyme oxidation scavengers disclosed in EP 92870018.6 filed Jan. 31, 1992. also particularly suitable are amine base catalyst stabilizers disclosed in EP 92870019.4 filed Jan. 31, 1992.

The detergent compositions according to the invention can be in liquid, paste or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "concentrated form", in such case, the liquid detergent compositions according to the present invention will contain a lower amount of water, compared to conventional liquid detergents.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. The pH of the treatment solution is preferably from 7 to 11 especially from 7.5 to 10.5.

The process and compositions of the invention can also be used as additive during laundry operations.

What is claimed is:

1. A dye transfer inhibiting composition comprising:

i) a metallo catalyst selected from the group consisting of porphyrins, phthalocyanines and mixtures thereof in an anount such that when the dye transfer inhibitig composition is added to a wash solution, the metallo catalyst is present in a concentration of from $10^{-8}$ to $10^{-3}$ molar;

wherein said porphyrins have the formula (I), (I)

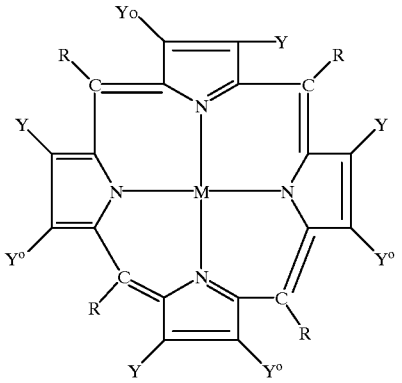

wherein M is a transition metal capable of sustaining oxidation and optionally may also be joined to one or more axial ligands in addition to the four nitrogens; each Y and Y° is independently H, fluoro or chloro subject to the provision that at least one Y or Y° is fluoro or chloro; and each R is:

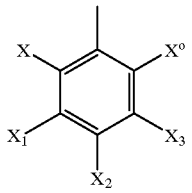

wherein X and X° are independently H or a non-water solubilizing electronegative group; and $X_1$, $X_2$ and $X_3$ are independently H or a water solubilizing electronegative group, subject to the provision that no more than two of $X_1$, $X_2$ and $X_3$ are water solubilizing electronegative groups, or wherein said porphyins are compounds of formula I wherein the water solubilizing groups are in water soluble salt form, and;

wherein said phthalocyanines have a phthalocyanine nucleus, M Pc, of the formula (II):

(II)

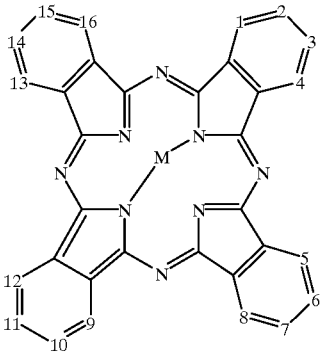

wherein M is selected from Fe, In, Co, Ru, Rh, Mo or V; and further wherein the phthalocyanine absorbs electromagnetic radiation at a wavelength from 650 nm to 800 nm; and ii) an amount of a bleaching atgent selected from the group consisting of perborates, percarbonates, perphosphates, peroxyhydrates and mixtures thereof such that the composition achieves a level of dye oxidation between 40% to 100% of the maximum percent of dye oxidation.

2. A dye transfer inhibiting composition according to claim 1 wherein the porphyrins have one or more of the following features:

a) Y and Y° on each porphyrin ring are independently H or chloro subject to the provisions that at least one Y or Y° is chloro, b) one of $X_1$, $X_2$ and $X_3$ is $SO_3H$, c) at least two of X, X°, $X_1$, $X_2$ and $X_3$ are chloro, and d) M is Mn or Fe.

3. A dye transfer inhibiting composition according to claim 1, wherein the phthalocyanine has the formula:

$$\text{M Pc (O—R)}_a\text{X}_b(\text{SO}_3\text{A})_d$$

wherein

M Pc is a phthalocyanine nucleus as defined in Formula II and the O—R and X groups are attached to one or more or the 16 peripheral carbon atoms of the phthalocyanine nucleus;

each R independently is an organic radical;

each X independently is a halogen or hydrogen;

A is selected from H, a metal, ammonium or substituted ammonium;

a is from 1 to 16:

b is from 0 to 15:

d is from 0.1 to 50; and a+b is from 1 to 16.

4. A dye transfer inhibiting composition according to claim 1, where the phthalocyanine has the formula:

$$\text{M Pc(O—R}^1)_a\text{X}_b$$

wherein:

M Pc as defined in Formula (II)

$R^1$ is selected from optionally substituted aryl and optionally substituted heteroaryl;

X is halogen or H;

a is an integer from 1 to 16;

b is an integer from 0 to 15; and a+b is equal to 16.

5. A dye transfer inhibiting composition according to claim 1, wherein each water solubilizing electronegative group is independently selected from the group consisting of $SO_3H$ and COOH; each non-water solubilizing electronegative group is independently selected from the group consisting of fluoro, chloro, bromo, and $NO_2$; and each electronegative group is independently selected from the group consisting of fluoro, chloro, brqnio, $SO_3H$, COOH and $NO_2$.

6. A dye transfer inhibiting composition according to claim 5, further comprising a bleach activator.

7. A dye transfer inhibiting composition according to claim 1, which is a detergent additive in the form of a non-dusting granule or a liquid.

8. A detergent composition which comprises a dye transfer inhibiting composition according to claim 1, further comprising enzymes, surfactants, and builders.

9. A detergent composition according to claim 8, comprising an anionic surfactant mixture comprising sulfonates and sulfates in a weight ratio of sulfonates to sulfates offrom 3:1 to 1:1.

10. A detergent composition which comprises a dye transfer inhibiting composition according to claim 1, further comprising a cellulase.

11. A dye transfer inhibiting composition according to claim 1, wherein the metallo catalyst is present in an amount such that when the dye transfer inhibiting composition is added to a wash solution, the metallo catalyst is present in a concentration of from $10^{-6}$ to $10^{-4}$ molar.

12. A detergent composition comprising:

a) a dye tasfer inhibiting composition, comprising:

i) a metallo catalyst selected from the group consisting of porphyrins, phthalocyanines and mixtures thereof in an amount such that when the dye transfer inhibiting composition is added to a wash solution, the metallo catalyst is present in a concentration of from $10^{-8}$ to $10^{-3}$ molar, wherein porphyrins have the formula (I):

(I)

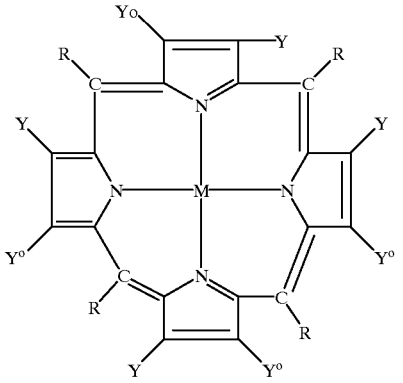

wherein M is Fe, Mn, V, Rh, Ru, or Co, and optionally may be joined to one or more axial ligands in addition to the four nitrogens, each Y and Y° is independently H, fluoro or chloro subject to the provisions that at least one Y or Y° is fluoro or chloro, and each R is:

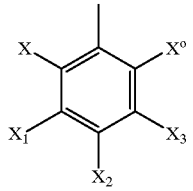

wherein X and X° are independently H, fluoro, chloro, bromo, or $NO_2$, and $X_1$, $X_2$ and $X_3$ are independently H, fluoro, chloro, bromo, $SO_3H$, COOH or $NO_2$, subject to the provision that: no more than two of $X_1$, $X_2$ and $X_3$ are $SO_3H$ or COOH, or wherein said porphyrins are compounds of formula I wherein the water solubilizing groups are in water soluble salt form, and;

wherein said phthalocyanines have a phtHalocyanine nucleus, M Pc, of the formula (II):

(II)

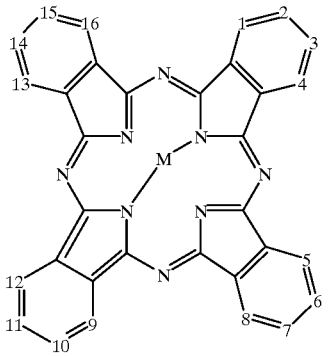

wherein M is selected from Fe, Mn, Co, Ru, Rh, Mo or V; and further wherein the phthalocyanine absorbs electromagnetic radiation at a wavelength from 650 nm to 800 nm; and ii) an amount of bleaching agent such that the composition achieves a level of dye oxidation between 40% to 100% of the maximum percent of dye oxidation, and b) an anionic surfactant mixture comprising sulfonates and sulfates in a weight ratio of sulfonates to sulfates of from 3:1 to 1:1.

13. A detergent composition according to claim 12, further comprising a bleach activator selected from the group consisting of TAED, NOBS, ISONOBS, PAG, and mixtures thereof.

14. A detergent composition according to claim 12, wherein the bleaching agent is selected from the group consisting of hydrogen peroxide, perborates, persulfates, percarbonates, peroxydisulfates, perphosphates, peroxyhydrates, organic peroxyacids, enzymatic systems capable of generating hydrogen peroxide, and mixtures thereof.

15. A detergent composition according to claim 12, wherein M of formula I is selected from the group consisting of Mn, Fe and mixtures thereof, and the M of formula II is selected from the group consisting of Mn, Fe and mixtures thereof.

16. A detergent composition according to claim 12, wherein the detergent composition is in a granular form and has a density of from 550 to 950 g/l.

17. A detergent composition according to claim 16, further comprising a water-insoluble aluminosilicate builder and a water-soluble carboxylate chelating agent.

18. A dye transfer inhibiting composition comprising:

(i) a metallo catalyst selected from the group consisting of porphyrins, phthalocyanines and mixtures thereof in an amount such that when the dye transfer inhibiting composition is added to a wash solution, the metallo catalyst is present in a concentration of from $10^{-8}$ to $10^{-3}$ molar, wherein the porphyrins have the formula (I):

(I)

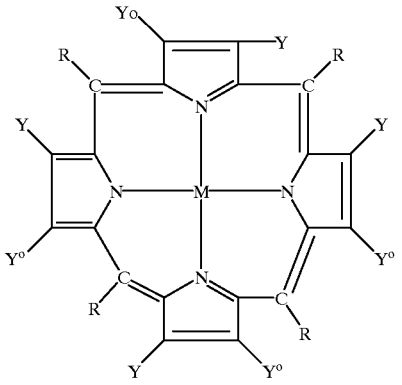

wherein M is Fe Cr, Mn, V, Rh, Ru, or Co, and optionally may be joined to one or more axial ligands in addition to the four nitrogens, each Y and Y° is independently H, fluoro or chloro subject to the provisions that at least one Y or Y° is fluoro or chloro, and each R is:

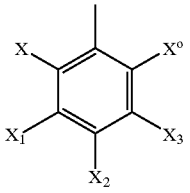

wherein X and X° are independently H, fluoro, chloro, bromo, or $NO_2$, and $X_1$, $X_2$ and $X_3$ are independently H, fluoro, chloro, bromo, $SO_3H$, COOH or $NO_2$, subject to the provision that: no more than two of $X_1$, $X_2$ and $X_3$ are $SO_3H$ or COOH, or wherein said porphyrins are compounds of fomiula I wherein the water solubilizing groups are in water soluble salt form, and;

wherein said phthalocyanines have a phthalocyanine nucleus, M Pc, of the formula (I):

(1)

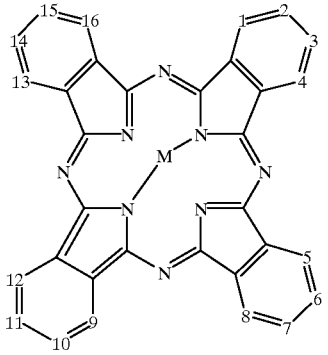

wherein M is selected from Fe, Mn, Co, Ru, Mo or V; and further wherein the phthalocyaninc absorbs electromagnetic radiation at a wavelength from 650 nm to 800 nm;

ii) an amount of bleaching agent such that the composition achieves a level of dye oxidation between 40% to 100% of the maximum percent of dye oxidation;

iii) a bleach activator; and iv) an anionic surfactant mixture comprising sulfonates and sulfates in a weight ratio of sulfonates to sulfates of from 3:1 to 1:1.

19. A detergent composition according to claim 18, wherein the bleaching agent is selected from the group consisting of hydrogen peroxide, perborates, persulfates, percarbonates, peroxydisulfates, perphosphates, peroxyhydrates, organic peroxyacids, enzymatic systems capable of generating hydrogen peroxide, and mixtures thereof.

20. A dye transfer inhibiting composition according to claim 18, wherein said bleach activator is selected from the group consisting of TAED, NOBS, ISONOBS, PAG, and mixtures thereof.

* * * * *